United States Patent [19]

Candow

[11] Patent Number: 5,024,438

[45] Date of Patent: Jun. 18, 1991

[54] DETACHABLE GOLF PUTTER EXTENSION

[76] Inventor: A. J. Candow, 2721 Riverbluff Ct., Villa 99, Sarasota, Fla. 34231

[21] Appl. No.: 505,835

[22] Filed: Apr. 6, 1990

[51] Int. Cl.[5] ..... A63B 53/14

[52] U.S. Cl. ..... 273/81 R; 273/81.2; 273/81 D; 135/76; 16/114 R; 74/544; 74/548

[58] Field of Search ..... 273/80 D, 80.1, 80.8, 273/81 R, 81 D, 81.2, 162 F, 165, 77 B; 403/361, 377; 135/76; 16/108, 114 R; 74/544, 548, 557

[56] References Cited

U.S. PATENT DOCUMENTS

| | | | |
|---|---|---|---|
| 2,949,304 | 8/1960 | Williams | 273/80 D |
| 3,188,086 | 6/1965 | Parmley | 273/80 D |
| 3,269,743 | 8/1966 | Barreca | 403/377 |
| 3,614,143 | 10/1971 | Stevens | 273/81.2 X |
| 4,163,554 | 8/1979 | Bernhardt | 273/80 C |
| 4,669,726 | 6/1987 | Lempio | 273/81.2 |

FOREIGN PATENT DOCUMENTS

| | | | |
|---|---|---|---|
| 344293 | 3/1960 | Switzerland | 403/377 |
| 2030209 | 4/1980 | United Kingdom | 403/377 |

OTHER PUBLICATIONS

"Pendulum Putter", Gold Digest, Feb. 1988, p. 111.

*Primary Examiner*—Edward M. Coven
*Assistant Examiner*—William M. Pierce
*Attorney, Agent, or Firm*—Charles J. Prescott

[57] ABSTRACT

A detachable golf putter extension structured to provide a substantially increased putter shaft length for a conventional golf club putter only during use, while being detachable to allow the putter and the device to be easily stored in conventional golf bags and the like. The putter extension includes an elongated rigid extension shaft having a male ferrule upwardly extending from its lower end and an exterior gripping surface extending over the extension shaft from its upper end toward, but not beyond, the male ferrule. The invention is particularly adapted to be retrofit onto existing golf putters by providing a rigid, tubular sleeve which is sized to be slid into, and then rigidly anchored within, the upper end of the golf putter shaft after a suitable hole has been formed into the upper end of the putter grip. The sleeve is formed having a female ferrule which snugly receives the male ferrule formed into the extension shaft so that the putter extension is held coaxial with, and upwardly extending from, the golf putter shaft.

2 Claims, 1 Drawing Sheet

10
24
22
14
16
12
18
30
20
28
26
32
38
40
34
36
42

DETACHABLE GOLF PUTTER EXTENSION

BACKGROUND OF THE INVENTION

This relates generally to golf clubs, and more particularly to a detachable golf putter extension structured to provide substantially increased putter shaft length, stability and accuracy during use.

A great deal of attention has been given to unique golf club putter designs for improved putting. This is so because the majority of (counted) golf strokes occur on the putting green for many golfers. Applicant is aware of a number of U.S. patents which have disclosed various structural improvements to golf club putters as follows:

| | |
|---|---|
| 4,674,747 | Frenchik |
| 3,539,185 | Andis |
| 4,826,168 | McGuire, et al. |
| 4,437,663 | Crisci |
| 3,524,646 | Wheeler |
| 3,663,019 | Palotsee |
| 3,102,726 | Barrett |
| 4,252,317 | Vezina |

Typically, golfers putt from a crouched position using golf putters of standard length. From this unsteady position, accurate putting is more difficult. However, a new style of golf putter has been introduced. This new putter takes the form of an elongated club shaft which extends upwardly from the golf head when laid atop the ground to the vicinity of the user's chest area. It has been, and will herein be, referred to as a "pendulum-style long putter" or "long putter". The mode of using this new golf club design is described in more detail in the detailed description portion of this application. These long putters allow the golfer to putt from a more upright, stable, relaxed position, and to more freely swing the head of the putter more consistently as a pendulum.

Applicant has found great benefit in using such putters; however, to date, the only forms of these pendulum-style long putters available have been those with solid or fixed length, elongated club shafts. Thus, for the golfer wishing to use such long putters, an entirely new golf club putter must be purchased.

These long putters also necessarily include their own style putter head. Many golfers have invested a considerable amount of money in putters which incorporate sophisticated, high technology design into the club head and such technology must be sacrificed if the golfer wishes to purchase one of these long putters presently marketed.

An additional problem with the fixed-length long putters resides in their storage when not in use. Most golf bags are not designed of sufficient length to properly accommodate one of these long putters which extend beyond the upper end of the gold bag a considerable distance further than the other golf clubs contained in the bag and will not fit under the club hood of the bag. Such fixed-length long putters may not even fit into smaller trunks of automobiles.

The present invention provides a device in kit form which facilitates the conversion of any conventional putter into a long putter. The detachable golf putter extension may thus be made connectable onto the upper end of any golf club putter shaft so that the user's present putter may be utilized either as a long putter or as a conventional putter as desired. Additionally, storage of the invention and corresponding modified putter is no problem in conventional golf bags and conveyance equipment as the device is easily detachable for separate storage. Of course, the invention is also intended to be used in conjunction with newly manufactured golf club putters in combination.

BRIEF SUMMARY OF THE INVENTION

This invention is directed to a detachable golf putter extension structured to provide a substantially increased putter shaft length for a conventional golf club putter only during use, while being detachable to allow the putter and the invention to be easily stored in conventional golf bags and the like. The putter extension includes an elongated rigid extension shaft having a male ferrule at its lower end and an exterior gripping surface extending over the extension shaft from its upper end toward, but not beyond, the male ferrule. The invention is particularly adapted to be retrofit onto existing golf putters by also providing a tubular, rigid sleeve which is sized to be slid into, and then rigidly anchored within, the upper end of the golf putter shaft after a suitable hole has been formed into the upper end of the putter grip. The sleeve is formed having a female ferrule which snugly receives the male ferrule formed into the extension shaft so that the putter extension is held coaxial with, and upwardly extending from, the golf putter shaft.

It is therefore an object of this invention to provide a detachable golf putter extension to convert any conventional golf putter into a pendulum-style long putter.

It is another object of this invention to provide a detachable golf putter extension which will facilitate use of an existing golf putter in its original length, as well as its use as a pendulum-style long putter.

It is another object of this invention to provide a pendulum-style long putter which includes a detachable golf putter extension which is removable for easy storage of both components thereof.

It is yet another object of the above invention to be provided for installation by individuals, golf shops, and golf club manufacturers.

In accordance with these and other objects which will become apparent hereinafter, the instant invention will now be described with reference to the accompanying drawings.

DETAILED DESCRIPTION OF THE INVENTION

Figures 1, 2, 3, 4:
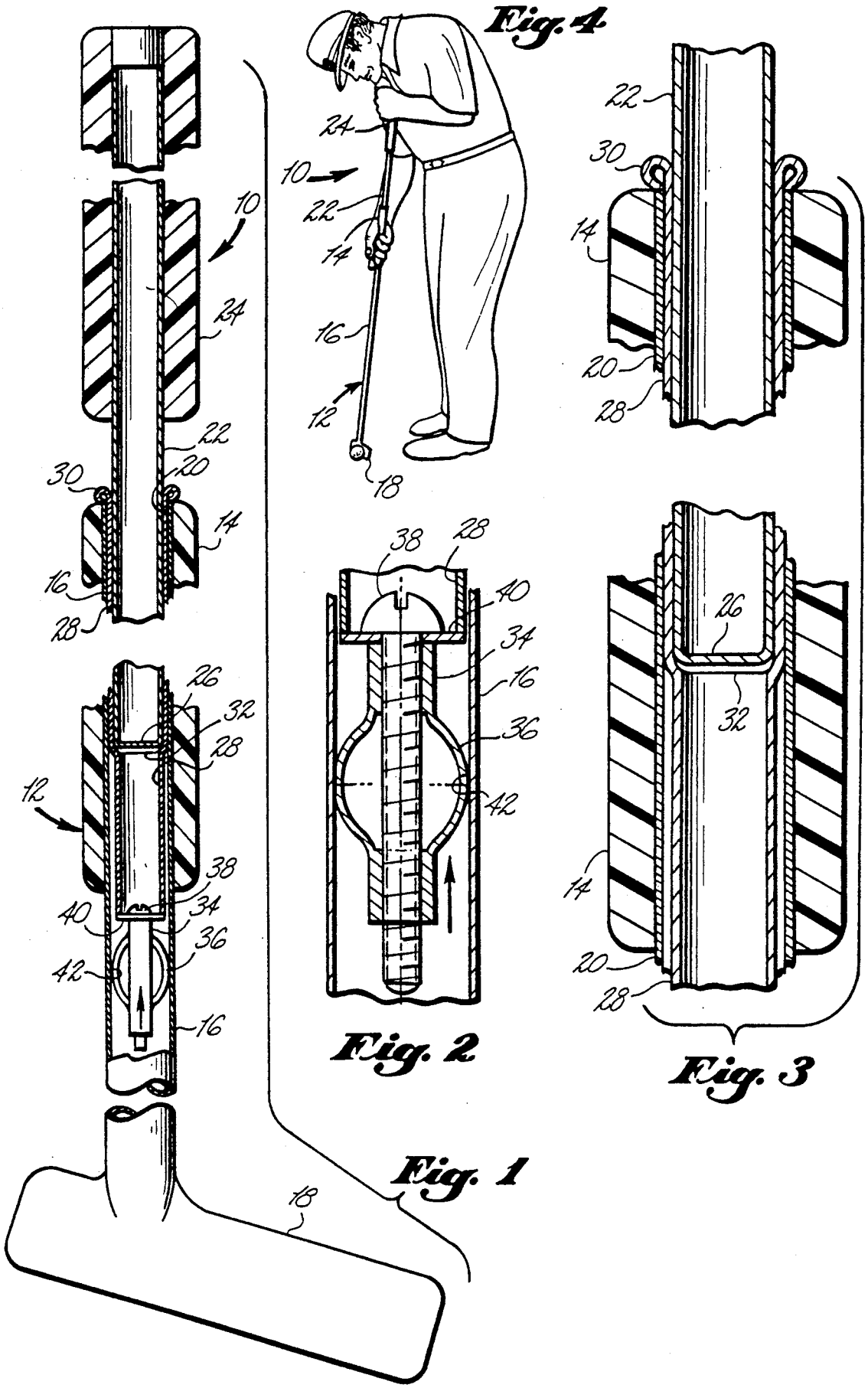
FIG. 1 is a longitudinal broken section view of the invention detachably connected to, and upwardly extending from, a conventional golf putter.
FIG. 2 is an enlarged view of the anchoring means of the present invention.
FIG. 3 is an enlarged view of the mating male and female ferrules of the present invention.
FIG. 4 is a perspective view of the invention detachably connected to a conventional golf putter in use.

Referring now to the drawings, and particularly to FIGS. 1, 2 and 3, the preferred embodiment of the invention is shown generally at numeral 10 in conjunction with a conventional golf putter shown generally at numeral 12. The putter 12 includes an elongated, rigid, tubular shaft 16 having a rubber or leather grip 14 extending downward from the upper end of club shaft 16 over the upper portion thereof and having a putter head 18 disposed at the lower end of club shaft 16 in a conventional manner.

The invention 10 is provided generally in two parts and include a detachable golf putter extension shaft 22 having an extension grip 24 connected over the upper portion of extension shaft 22 and a tubular sleeve 28. Extension shaft 22 includes a male ferrule formed into its lower portion and integrally capped at 26 to provide a finished lower end appearance. The extension grip 24 is formed of molded rubber, leather, or the like and is sized in length for grasping by one of the user's hands, typically the user's left hand, if he is right handed, and visa-versa.

Sleeve 28 includes a female ferrule formed into its upper portion sized to very snugly, yet manually releasably receive the male ferrule lower portion of extension shaft 22 therein. Sleeve 28 is necked down in diameter at 32 so as to provide a mechanical stop against the lower end cap 26 of extension shaft 22.

Sleeve 28 is also provide with an expandable anchor 36 which, in combination with sleeve 28 is sized for slidable insertion into the upper end of golf club shaft 16. This is typically facilitated by cutting or boring a hole into the upper end of club grip 14 for access. Sleeve 28, with anchor 36 rigidly connected and extending therebelow, are then inserted fully into golf club shaft 16 as shown. A rolled bead 30 is also provided in the upper end of sleeve 28 to provide a mechanical guide and stop for the proper insertion of sleeve 28 into golf club shaft 16 and also to provide a finished appearance.

After sleeve 28 and connected expandable anchor 36 are fully inserted into golf club shaft 16, a tool such as a slender screw driver may then be inserted into sleeve 28 so as to engage the slotted head of threaded fastener 38. Upon tightening fastener 38, the lower end of the expandable anchor 36 is drawn upward in the direction of the arrow by threaded engagement with the lower portion of fastener 38 so that its slitted mid-portions outwardly expand to strongly press against the inner wall of club shaft 16 at 42. It is this friction pressure created by further tightening of fastener 38 which permanently secures sleeve 28 within club shaft 16 as shown until such time as fastener 38 may be loosened.

Then, after sleeve 28 is secured within club shaft 16 as previously described, the golf putter extension 10 may be repeatedly inserted into, and removed from, the female ferrule portion of sleeve 28 as desired.

Referring additionally to FIG. 4, the invention 10 is shown in use. With the club head 18 resting atop the ground adjacent a golf ball, a right handed user as shown may grasp the club grip 14 with the right hand while the extension grip 24, generally in the region of the user's chest, may be grasped with the opposite or left hand. As should be now clear, the user remains in a more upright position for steadier, relaxed putting than if the user were to be required to hunch over to accommodate the conventional length of a golf putter.

It is here stressed that the invention 10, including sleeve 28, may be utilized either with existing conventional length putters, or may also be provided in original manufactured form by golf club manufacturers. It is submitted by applicant that the broader immediate use of the invention may be in conjunction with existing putters so as to provide the features of a pendulum-style long putter without the higher expense of buying an entirely new golf club putter and also providing the advantage to the golfer of being able to continue to use a favorite golf putter in either conventional or longer handled pendulum style mode of use.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. Apparatus for modifying a golf putter to provide a readily attachable and detachable putter shaft extension; the putter having a hollow shaft with a club head at one end and extending to a second end, a grip enclosing a portion of the hollow shaft extending from the second end towards the club head, and the grip having a hole in the end thereof exposing the hollow shaft end; comprising:

a putter modifying portion having a female ferrule sized to fit within the golf putter hollow shaft;

said female ferrule having a smooth, cylindrical inner surface extending from a first open end to a second end;

a flange element extending outwardly from said female ferrule first open end diametrically sized to extend at least over the golf putter hollow shaft at the second end of the golf putter hollow shaft, whereby said female ferrule first open end cannot extend into the gold putter hollow shaft;

said second end of said female ferrule, having an inwardly extending portion of reduced cross-sectional diameter with a threaded fastener shaft hole centrally located therein;

an anchor having a connection to said second end of said female ferrule;

said anchor having a portion expandable against the golf putter hollow shaft upon insertion of a threaded fastener through said threaded fastener shaft hole and into said anchor;

said putter shaft extension portion having a straight shaft with a first end formed as a male ferrule having a smooth outer surface fixed to fit snugly within said female ferrule;

said putter extension shaft extension grip connected over said putter extension shaft extending from said second end toward first end and ending above said male ferrule, whereby when said male ferrule is placed in said female ferrule said putter extension shaft will be coaxial with said putter hollow shaft.

2. Apparatus for modifying a golf putter in accordance with claim 1 wherein:

said flange element extending outwardly from said female ferrule first open end is a bead formed at said female ferrule first open end;

said putter shaft extension portion extends to the vicinity of a user's chest area when the golf putter is held in position for use.

* * * * *